United States Patent [19]

Faust et al.

[11] 4,032,212

[45] June 28, 1977

[54] STRAND ADAPTER FOR AERIAL CLOSURES AND CABLE TERMINALS

[75] Inventors: Carl Walter Faust, Dover; Arnold Ray Smith, Chester, both of N.J.

[73] Assignee: Bell Telephone Laboratories, Incorporated, Murray Hill, N.J.

[22] Filed: Nov. 28, 1975

[21] Appl. No.: 635,750

[52] U.S. Cl. ..... 339/109; 339/95 R; 339/263 L; 339/266 L

[51] Int. Cl.[2] ..... H01R 7/08

[58] Field of Search ..... 339/95 R, 109, 110 R, 339/263 R, 263 L, 264 R, 264 L, 266 R, 266 L

[56] References Cited

UNITED STATES PATENTS

| | | | |
|---|---|---|---|
| 1,420,790 | 6/1922 | Varney | 339/263 L |
| 1,798,815 | 3/1931 | Shepard | 339/266 L |
| 1,932,009 | 10/1933 | Becker | 339/263 L |
| 2,958,067 | 10/1960 | Hardy | 339/109 |
| 3,923,363 | 12/1975 | Kraft | 339/109 |

FOREIGN PATENTS OR APPLICATIONS

| | | | |
|---|---|---|---|
| 1,249,967 | 9/1967 | Germany | 339/95 R |
| 1,050,851 | 2/1959 | Germany | 339/266 R |

*Primary Examiner*—Roy Lake
*Assistant Examiner*—Mark S. Bicks
*Attorney, Agent, or Firm*—John W. Fisher

[57] ABSTRACT

A strand adapter for mechanically and electrically coupling aerial closures and cable terminals to a messenger cable is disclosed. The adapter is configured such that a range of messenger cable sizes can be advantageously accommodated. In addition, the adapter includes provisions for diminishing rotation during installation thereby simplifying the procedures for coupling aerial closures and cable terminals to a messenger cable.

5 Claims, 1 Drawing Figure

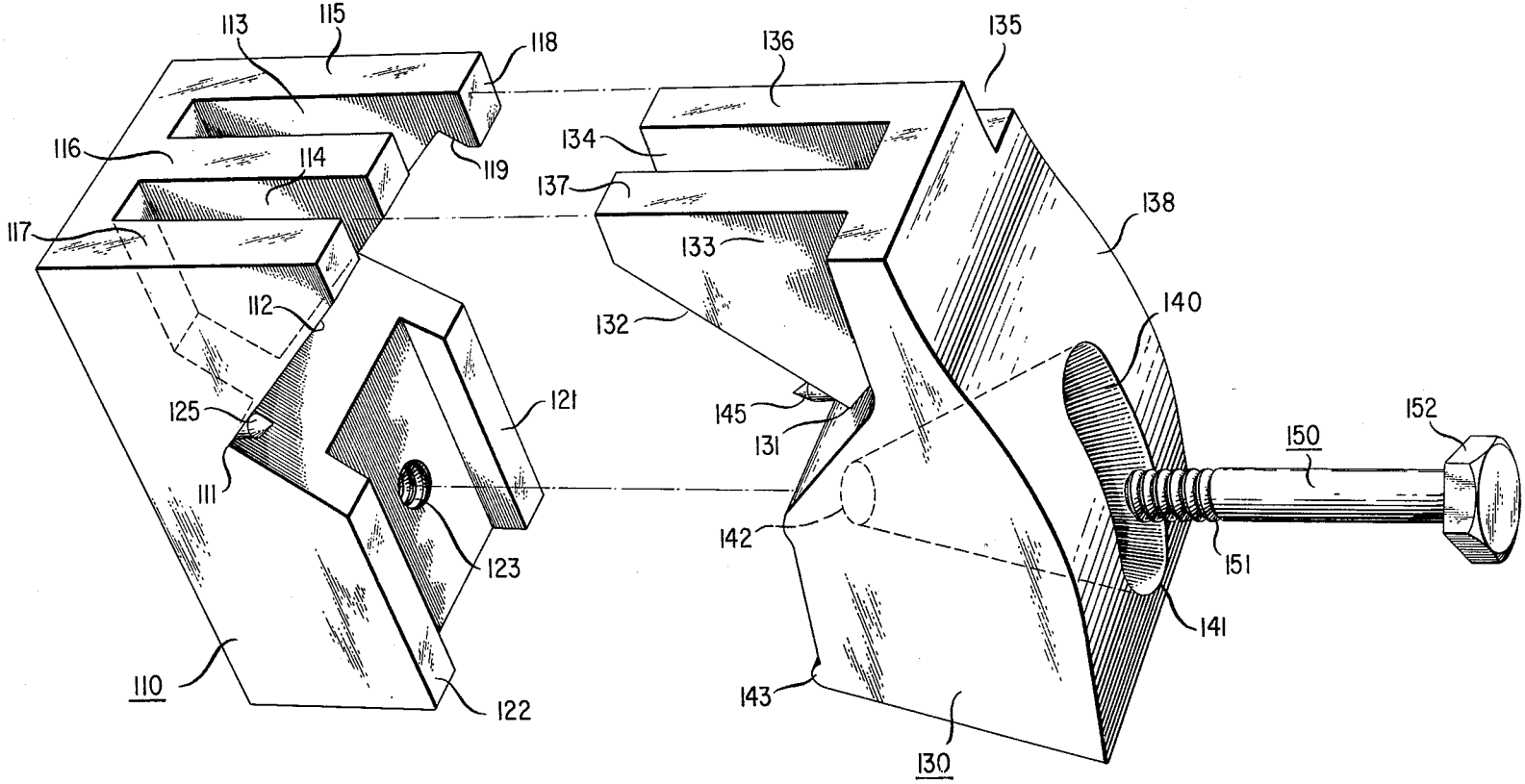
152
150
151
141
140
138
135
130
136
133
145
131
142
143
134
137
132
118
119
121
123
122
115
114
113
112
125
111
110
116
117

STRAND ADAPTER FOR AERIAL CLOSURES AND CABLE TERMINALS

BACKGROUND OF THE INVENTION

1. Field of the Invention

This invention relates to an electrical connector for coupling an aerial closure or a cable terminal to a messenger strand and, in particular, to a connector which has insulation piercing means for contacting the messenger strand.

2. Description of the Prior Art

The strand adapter or clamp, used for many years in telephone plant applications for coupling an aerial closure or a cable terminal to a messenger strand, is comprised to two die cast members which are held together by a clamping bolt. One member has a tapped hole for receiving the bolt while the other member has a pair of clearance holes for adapting the clamp so that it can accommodate various sizes of messenger strand. In addition, the member with the tapped hole includes a generally U-shaped groove at one end for engaging a tab on the aerial closure or cable terminal to secure either one of the latter apparatus to the messenger strand. For example, when the clamp is assembled with the bolt through a first one of the clearance holes, the clamp is attachable to either a 6M or a 10M strand, where M indicates thousands of pounds of tensile strength. However, in order to accommodate 2.2M or 6.6M strand the adapter must be disassembled, the two-hole member must be rotated 180° so that the bolt can be inserted through the other clearance hole and then all of the pieces must be reassembled. This procedure is not only time consuming, but it is also difficult to achieve in a field environment where a craftsperson might have to support the aerial closure or cable terminal while simultaneously undertaking the reconfiguration of the strand adapter. Moreover, in situations where the adapter is to be attached to a strand of self-supporting cable, it is necessary for the craftsperson to remove the insulation from the strand in the region of attachment in order to effect a proper electrical connection between the strand and the adapter.

In addition to the foregoing, it should be noted that the strand adapter referred to above has a number of other deficiencies. One of these is that prior to the completion of clamping there is no provision on the adapter for holding it in place even loosely on the strand. Another deficiency is that the craftsperson must hold the two die cast members tightly together during installation in order to prevent the rotation of one piece about the other as the clamping bolt is tightened.

Accordingly, it is one object of the present invention to configure an adapter which can advantageously accommodate a wide range of cable sizes without having to be disassembled and reassembled.

Another object is to decrease the amount of time required to effect a connection of an aerial closure or a cable terminal to a messenger strand.

A further object of the present invention is to eliminate the need for having to remove a portion of insulation covering a self-supporting strand in order to effect an electrical connection between the strand and the adapter.

Still a further object is to configure an adapter which can be advantageously loosely hung on the strand prior to securing the adapter to the strand.

Yet a further object of the present invention is to provide apparatus integral with the adapter for ensuring proper alignment of the assembly during the securing operation.

SUMMARY OF THE INVENTION

The foregoing and other objects of the invention are realized in an illustrative embodiment wherein a strand adapter includes first and second means for coupling apparatus to a messenger strand, which strand may have an outer diameter that is variable within predetermined limits, and means for securing the first and second means to one another and to the apparatus. Integral with the first means are means for supporting the first and second means on the messenger strand and means for diminishing the rotation of the first and second means and the apparatus as the securing means is actuated.

Accordingly, it is one feature of the present invention that the strand adapter can advantageously accommodate various sizes of messenger strand.

Another feature is that the adapter is so configured as to be self-supporting on the messenger strand during installation.

A further feature of the present invention is that the strand adapter can advantageously make an electrical connection with an insulated messenger strand without the prior removal of a portion of the insulation.

Yet a further feature is that the capability to make an electrical connection to an insulated strand directly reduces the possibility of corrosion damage to the strand.

Still another feature is that the strand adapter is configured such that any rotation of the adapter is diminished during installation as the securing means is actuated.

BRIEF DESCRIPTION OF THE DRAWING

The aforementioned objects and features of the invention, as well as other objects and features, will be better understood upon a consideration of the following detailed description and the appended claims taken in conjunction with the accompanying drawing which shows an exploded perspective view of a strand adapter in accordance with the present invention.

DETAILED DESCRIPTION

The strand adapter shown in the FIGURE is comprised of a first member 110, a second member 130, and a bolt 150 for securing the members to one another. Members 110 and 130 in the preferred embodiment are fabricated of die cast aluminum, but any other materials which offer both electrical conductivity and structural strength may be used. Also other manufacturing techniques such as milling or the like may be used to produce the members 110 and 130.

Member 110 is cast such that a generally V-shaped groove 111 is produced transversely through an inner portion. One side 112 of the V-shaped groove 111 is configured with a plurality of slots 113 and 114 therein so as to form a plurality of generally, equally spaced-apart teeth 115, 116, and 117 along an end portion of member 110. Tooth 115 has integral therewith a hook-like extension 118 which has a edge face 119 generally perpendicular with side 112 of the V-shaped groove 111. The hook-like extension 118 is used to engaged a messenger strand (not shown) for support purposes during the initial installation of the adapter; that is, extension 118 permits members 110 and 130, when loosely connected by bolt 150, to be self-supported on the strand because of the engagement of edge face 119 and 112 with an upper portion of the messenger strand.

An end portion of member 110 opposite the spaced-apart teeth 115 through 117 has a generally U-shaped slot therein formed by sidewall members 121 and 122. This U-shaped slot is used to engage a coupling (not shown) on apparatus such as splice closures or cable terminals. The coupling fits between the sidewall members 121 and 122 and has an aperture therein which allows bolt 150 to pass through it. When member 130 is affixed to member 110 by bolt 150, and the bolt 150 is tightened by the engagement of threaded shaft 151 with a threaded aperture 123, the apparatus attached to the coupling is securely fastened to the adapter and the two are secured to the messenger strand.

Member 130, similar to member 110, is cast such that a generally V-shaped groove 131 is produced transversely through an inner portion. One side 132 of the V-shaped groove 131 is configured with a plurality of slots or openings 133, 134 and 135 so as to form a plurality of spaced-apart teeth 136 and 137 along an end portion of the member 130. Spaced-apart teeth 136 and 137 are arranged so as to intermesh with the spaced-apart teeth 115 through 117 of member 110 when member 130 is mated with member 110. This intermeshing of teeth partially enables the adapter to accommodate a range of sizes of messenger strand between the V-shaped grooves 111 and 131. For example, messenger strands having an outer diameter anywhere between 3/16 of an inch and ½ of an inch may be readily accommodated.

To allow for this variation in the spacing between the V-shaped groove 111 in member 110 and the V-shaped groove 131 in member 130, while ensuring the proper engagement of bolt head 152 with member 130, an outer face 138 of member 130 is slightly contoured so as to have a generally convex surface. Moreover, an aperture 140, which is generally perpendicular to the V-shaped groove 131 and which receives bolt 150, is provided with a taper to allow for the variable spacing between the V-shaped grooves 111 and 131 in members 110 and 130, respectively. At the convex surface 138 the aperture 140 has a generally elliptical cross section 141 while at its opposite end the aperture 140 has a generally circular cross section 142. This tapered shape allows member 130 to be shifted slightly in a plane containing bolt 150 and slot 134.

Because of the variability in spacing between the members 110 and 130, an end portion of member 130 opposite the spaced-apart teeth 136 and 137 has a raised lip 143 with a generally semicircular cross section. The convex surface 138, in conjunction with the tapered aperture 140, enables the raised lip 143 to serve as a point of rotation of the spaced-apart teeth 136 and 137 outwardly away from the spaced-apart teeth 115 through 117 thereby advantageously allowing the adapter to accommodate the desired range of messenger strand sizes noted above.

At the root of the spaced-apart teeth 115, 116, 117, 136, and 137 are a number of insulation piercing members, such as piercing member 125 in member 110 and piercing member 145 in member 130. In applications where the messenger strand is integral with a multipair communications cable, that is, a so-called "self-supporting" cable, the insulation piercing members 125 and 145 enable an electrical connection to be established between the adapter and the messenger strand without having to remove a portion of the insulation from the strand beforehand. Consequently, this capability greatly reduces the amount of time and the number of steps which must be undertaken by a craftsperson to effect the connection of apparatus, such as a splice closure or cable terminal, to the messenger strand by use of the adapter. In addition, the corrosion resistance of the connection is improved since the strand is not directly exposed to the elements.

It should be noted that the hook-like extension 118 and the spaced-apart teeth 115, 116, 117, 136, and 137 cooperate to diminish the amount of vertical rotation that could be imparted when bolt 150 is tightened to secure the adapter and apparatus to the messenger strand. Moreover, the insulation piercing members 125 and 145 substantially eliminate any circumferential rotation of the adapter and apparatus about an axis of the strand.

In summary, a strand adapter has been described which can be advantageously utilized to couple, both electrically and mechanically, apparatus such as a splice closure or cable terminal to a messenger strand having an outside diameter which is variable between predetermined limits. Also, the adapter includes provisions for making it self-supporting during installation and for diminishing any type of rotation that may be imparted to it during the securing operation.

In all cases it is to be understood that the above-described embodiment is illustrative of but a small number of many possible specific embodiments which can represent applications of the principles of the invention. Thus, numerous and various other embodiments can readily be devised in accordance with these principles by those skilled in the art without departing from the spirit and scope of the invention.

We claim:

1. A strand adapter including first and second mating members for coupling apparatus to a messenger strand, said strand having an outer diameter which is variable within predetermined limits, each of said members having a generally V-shaped groove transversely through a first inner portion, one side of each groove having a plurality of slots therein so as to form a plurality of generally, equally spaced-apart teeth at an end portion of each member, said spaced-apart teeth of said first member aligned to intermesh with said spaced-apart teeth of said second member, means for securing said first and second members to one another and to said apparatus, means, integral with said first member, for supporting said first and second members on said messenger strand when said first and second members are loosely coupled to one another in an unmated relationship, said supporting means comprising a hook-like extension integral with an outer one of said spaced-apart teeth of said first member, said extension having an edge face generally perpendicular to said one side of said first member V-shaped groove and generally parallel to another side of said first member V-shaped groove, said supporting means further diminishing rotation of said first member and said apparatus in a direction about an axis of said securing means before said second member is brought into a mated relationship with said first member upon actuation of said securing means, and means, integral with said first and second members, for diminishing the rotation of said first and second members and said apparatus circumferentially about an axis of said messenger strand as said securing means is further actuated.

2. The strand adapter in accordance with claim 1 wherein said means for diminishing rotation of said first and second members circumferentially about an axis of said messenger strand comprises a plurality of insulation piercing members having conical-shaped tips, at least one such member positioned at a root of one of said spaced-apart teeth in each of said first and second members.

3. The strand adapter in accordance with claim 1 wherein said second member further includes a raised lip having a generally semi-circular cross section and extending across said second member opposite to said end portion containing said spaced-apart teeth, said raised lip serving as a point of rotation of said spaced-apart teeth of said second member outwardly away from said spaced-apart teeth of said first member, a convex surface on an outer face opposite said spaced-apart teeth, and a tapered aperture extending through a second inner portion of said second member, said aperture aligned generally perpendicular to said V-shaped groove and having a generally elliptical cross section at said convex surface and a generally circular cross section at an opposite end, said convex surface and said aperture cooperating so as to allow adaptation of said adapter for clamping to a predetermined range of different messenger strand sizes.

4. A strand adapter comprising first and second members, each of said members having a generally V-shaped groove transversely through a first inner portion, one side of each groove having a plurality of slots therein so as to form a plurality of generally, equally spaced-apart teeth at an end portion of each member, said spaced-apart teeth of said first member aligned to intermesh with said spaced-apart teeth of said second member, said first member further including a hook-like extension integral with an outer one of said spaced-apart teeth, said extension having an edge face generally perpendicular to said one side of said first member V-shaped groove and generally parallel to another side of said first member V-shaped groove, said extension engaging a messenger strand for support purposes, a plurality of insulation piercing members having conical-shaped tips, at least one such member positioned at a root of one of said spaced-apart teeth in each of said first and second members, and means for securing said first member to said second member, said hook-like extension further serving, in conjunction with said spaced-apart teeth, to diminish the rotation of said first and second members as said first member is secured to said second member by said securing means.

5. The strand adapter in accordance with claim 4 wherein said second member further includes a raised lip having a generally semicircular cross section and extending across said second member opposite to said end portion containing said spaced-apart teeth, said raised lip serving as a point of rotation of said spaced-apart teeth of said second member outwardly away from said spaced-apart teeth of said first member, a convex surface on an outer face opposite said spaced-apart teeth, and a tapered aperture extending through a second inner portion of said second member, said aperture aligned generally perpendicular to said V-shaped groove and having a generally elliptical cross section at said convex surface and a generally circular cross section at an opposite end, said convex surface and said aperture cooperating so as to allow adaptation of said adapter for clamping to a predetermined range of different messenger strand sizes.

* * * * *